United States Patent [19]

Wanninkhof et al.

[11] Patent Number: 4,584,797

[45] Date of Patent: Apr. 29, 1986

[54] SANDING DEVICE

[75] Inventors: Peter Wanninkhof, Oosterhout; Antonie J. Moolenaar, Dorst, both of Netherlands

[73] Assignee: Skil Nederland B.V., Breda, Netherlands

[21] Appl. No.: 604,008

[22] Filed: Apr. 26, 1984

[30] Foreign Application Priority Data

Apr. 26, 1983 [NL] Netherlands ..... 8301475

[51] Int. Cl.[4] ..... B24B 23/06

[52] U.S. Cl. ..... 51/170 EB

[58] Field of Search ..... 51/170 R, 170 EB, 135 R

[56] References Cited

U.S. PATENT DOCUMENTS 2,991,595 7/1961 Addis .

4,334,390 6/1982 Sumerau .

FOREIGN PATENT DOCUMENTS 536172 6/1973 Fed. Rep. of Germany .

*Primary Examiner*—Roscoe V. Parker

*Attorney, Agent, or Firm*—Birch, Stewart, Kolasch & Birch

[57] ABSTRACT

A portable belt sander includes a housing, a driving roller journalled therein, a motor with a transmission arranged in the housing for driving the roller, a control-roller journalled in a subframe movable relative to the housing and an endless sanding belt passed around the two rollers. The driving roller has a running surface whose width is materially smaller than that of the sanding belt.

11 Claims, 4 Drawing Figures

SANDING DEVICE

BACKGROUND OF THE INVENTION

The invention relates to a portable sanding device mainly comprising a housing, a driving roller journalled therein, a motor with a transmission arranged in said housing for driving said roller, a control-roller journalled in a subframe movable relative to the housing and an endless sanding belt passed around the two rollers.

Such a portable sanding device is known in many designs.

SUMMARY OF THE INVENTION

The invention has for its object to construct a sanding device of the kind set forth in the preamble so as to be simpler, lighter, cheaper and, moreover, safer, whilst less disturbing noise is produced and the same capacity is maintained.

The device according to the invention is distinguished in that the driving roller has a running surface whose width is materially smaller than that of the sanding belt.

Owing to this design the driving roller can be journalled so that it is better supported, which not only prolongs the lifetime but also provides the possibility of reducing the weight of the driving roller and the support and of simplifying the design thereof, for example, by means of moulded parts such as spray-cast parts or sinter parts. The latter also reduces costs of mounting. The safety for the user can be enhanced by the possibility of arranging screening means at the side of the driving roller without projecting laterally from the device.

When the running surface is formed by a sleeve of elastic material connected with a hub-shaped carrier, the sleeve can be more readily arranged on the hub than in the conventional designs in which the running surface sleeve is usually vulcanized or glued owing to the smaller width of the running surface. It is now sufficient to press it on.

According to the invention the transmission between the motor and the driving roller is preferably formed by at least one rope transmission. Thanks to this rope transmission the known screeching noise of a gear wheel transmission in such hand tools is considerably reduced. Moreover, there is no need for using grease lubrication and hence grease chambers, which allows larger tolerances for the housing parts. This contributes to a simple mounting operation and lower costs of manufacture.

The invention furthermore relates to the bearing of the control-roller, preferably in the form of plain bearings arranged in a subframe of heat conducting material. The plain bearings are preferably of sintered material. Owing to the arrangement of the plain bearings in a subframe of thermally conductive material heat is better conducted away so that a control-roller of synthetic resin can be used. Moreover, these bearings are cheaper than the conventional roller bearings.

BRIEF DESCRIPTION OF THE DRAWINGS

The invention will be described more fully with reference to the drawing showing two embodiments.

The drawing shows in

DETAILED DESCRIPTION OF THE DRAWINGS

Figure 1:
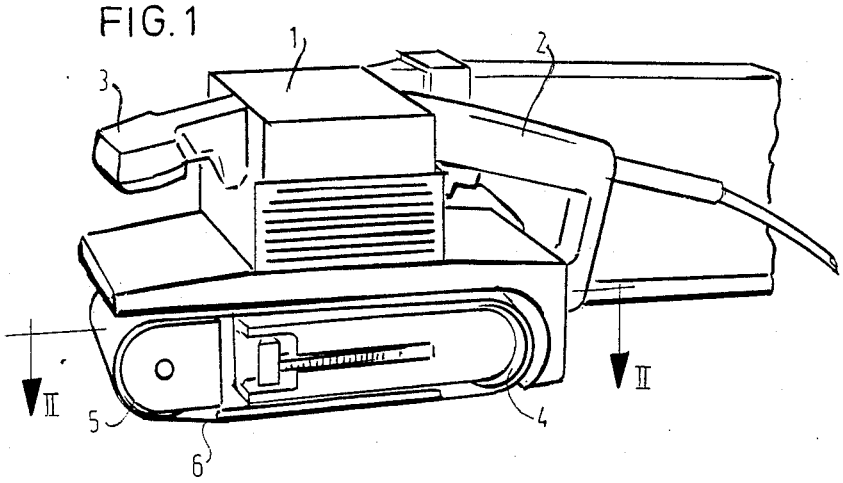
FIG. 1 a perspective view of a portable belt sanding device.

Referring to FIG. 1 reference numeral 1 designates the housing of the sanding device, said housing being provided with a handle 2, 3.

On the underside the device is provided with a driven roller 4 and a control-roller 5 around which a sanding belt 6 is passed. The housing accommodates an electric motor with a transmission to be described hereinafter for driving the roller 4.

Figure 2:
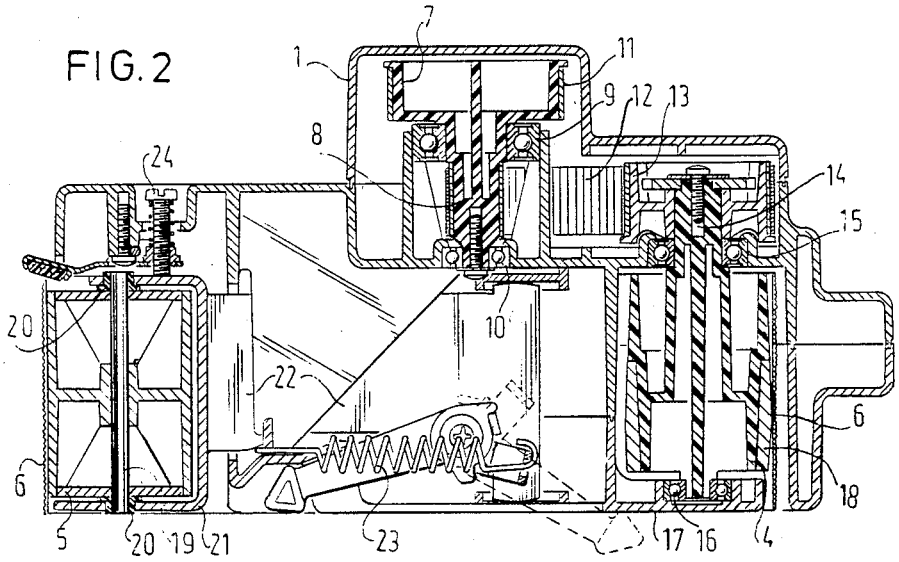
FIG. 2 a horizontal sectional view taken on the line II—II in FIG. 1.

In the embodiment shown in FIG. 2 the transmission is formed by a two-step rope drive; only the large wheel 7 of the first step is shown. The wheel 7 is in this case a moulded part provided with an integrally moulded shaft 8 journalled by means of roller bearings 9, 10 in the housing 1. The moulded part may be manufactured by spray-casting or sintering process from light-weight metal or synthetic resin. The rope 11 passed around the wheel 7 is assumed to pass to a pinion of the electric motor above the plane of the drawing in FIG. 2.

The shaft 8 serves, in addition, as a pinion for a second rope 12 passing to the rope wheel 13. The rope wheel 13 is fastened to the shaft 14 of the driven roller 4. The shaft 14 is journalled by means of a roller bearing 15 in the housing. On the other side of the driven roller 4 a bearing 16 is supported in a housing part 17 extending between the runs of the sanding belt 6.

According to the invention the driven roller 4 has a running surface 18, the width of which is appreciably smaller than the width of the sanding belt 6. Practical tests have shown that such a width of the running surface 18 is largely sufficient for a satisfactory drive without hindering the true run of the sanding belt 6, whilst the driven roller 4 at the side of the running surface is not in contact with the sanding belt. The running surface 18 constructed in the form of a rubber sleeve pressed on a hub-shaped part of the roller 4 has a conventional barrel shape.

The hub part of the roller 4 constitutes together with the supporting shaft 14 a single moulded part so that the weight of the roller 4 and the cost price can be minimized.

The control-roller 5 is provided with a pin-shaped rotary shaft 19 arranged at both ends in plain bearings 20 each fastened in a limb of a U-shaped bracket 21. The bracket is fastened to a subframe 22, which is slidably arranged in the housing 1 and which is moved away from the driven roller by means of a tensile spring structure 23 whilst moving along the control-roller 5. At the side of the control-roller 5 there is arranged a belt run monitoring mechanism 24, which moves the bracket 21 downwards or upwards in FIG. 2 respectively for steering the belt. The tensile spring mechanism 23 and the belt run monitoring mechanism 24 are known elements in such a device and will not be described further.

Figure 3:
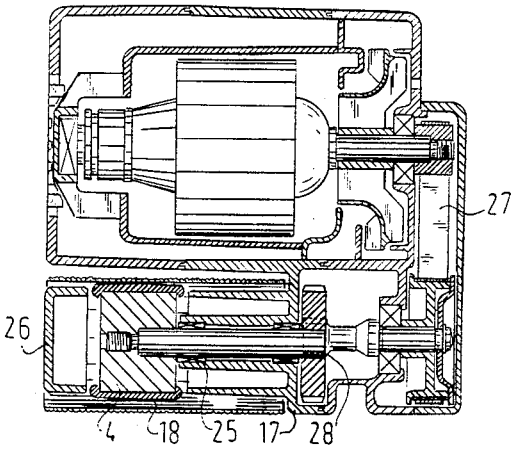
FIG. 3 a vertical sectional view near the driving roller of a second embodiment of the sanding belt device, FIG. 4 a bottom view of the sanding belt with a sole plate.

FIG. 3 shows an embodiment in which the driven roller 4 is provided with a carrying part, the width of which does not exceed that of the running surface 18. Thus the weight of the driven roller 4 is further reduced, whilst there is sufficient space for a unilateral bearing of the driven roller 4. The free side of the driven roller 4 is screened by a hood 26 connected with the housing part 17.

The drive of this embodiment is performed by means of a single rope transmission 27, which leads to a gear wheel transmission 28. As a matter of course, the gear wheel transmission 28 may be replaced by a second rope transmission.

Figure 4:
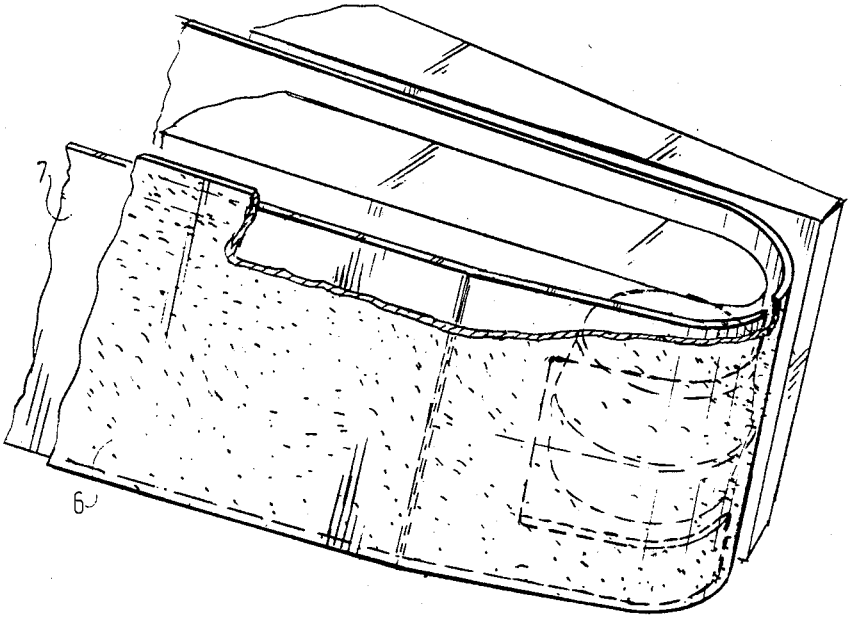

FIG. 4 illustrates the possibility of extending the foot plate 7 to a side beyond the driven roller, which provides a locally larger carrying surface of the belt. Moreover, the foot plate has a screening effect, which enhances safety. The part of the foot plate extending at the side of the roller furthermore absorbs lateral forces and thus protects the driven roller.

The devices shown thus permit of obtaining an undisturbed drive of the sanding belt 6 with a relatively narrow driven roller, of ensuring optimum safety for the user and of constructing a light-weight and cheap machine.

We claim:

1. A portable sanding device mainly comprising a housing, a driven roller journalled therein, a motor with a transmission arranged in said housing for driving said roller, a control-roller journalled in a sub-frame movable with respect to said housing and an endless sanding belt passed around said two rollers characterized in that the driven roller (4) is provided with a running surface (18), the width of which is substantially equal to half the width of the sanding belt (6).

2. A device as claimed in claim 1 characterized in that the width of the running surface is at the most equal to half the width of the sanding belt (6).

3. A device as claimed in claim 1 characterized in that the running surface is formed by a sleeve (18) of elastic material connected with a hub-like carrier (4).

4. A device as claimed in claim 3 characterized in that the width of said carrier (4) is at the most equal to that of said elastic sleeve (18).

5. A device as claimed in claim 3 characterized in that said hub-like carrier and an associated stub shaft is formed by a single moulded part.

6. A device as claimed in claim 3 characterized in that the transmission is formed by at least one rope transmission.

7. A device as claimed in claim 6, characterized in that the transmission is provided with rope wheels integrally formed with associated stub shafts by a single moulded part.

8. A device as claimed in claim 1 characterized in that a foot plate arranged between the rollers extends beyond the side of the driven roller (4).

9. A device as claimed in claim 1 characterized in that the control-roller (5) is journalled in a subframe (22) of thermally conductive material.

10. A device as claimed in claim 9 characterized in that the control-roller (5) is journalled by means of plain bearings (20) in the subframe (22).

11. A device as claimed in claim 10 characterized in that the plain bearings (20) are made from sintered material.

* * * * *